US007693469B2

(12) United States Patent
Suzuki et al.

(10) Patent No.: US 7,693,469 B2
(45) Date of Patent: Apr. 6, 2010

(54) IMAGE FORMING APPARATUS

(75) Inventors: Wataru Suzuki, Ebina (JP); Masahiro Sato, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 308 days.

(21) Appl. No.: 11/944,822

(22) Filed: Nov. 26, 2007

(65) Prior Publication Data

US 2008/0317517 A1 Dec. 25, 2008

(30) Foreign Application Priority Data

Jun. 22, 2007 (JP) ..... 2007-165433

(51) Int. Cl.
*G03G 15/01* (2006.01)
*G03G 15/20* (2006.01)
*G03G 15/16* (2006.01)

(52) U.S. Cl. ..... 399/302; 399/66; 399/308

(58) Field of Classification Search ..... 399/66, 399/302, 308, 309
See application file for complete search history.

(56) References Cited

U.S. PATENT DOCUMENTS

2004/0197111 A1* 10/2004 Kuroda ..... 399/66
2007/0009290 A1* 1/2007 Okabe ..... 399/302

FOREIGN PATENT DOCUMENTS

JP 2006-215134 8/2006

* cited by examiner

*Primary Examiner*—David M Gray
*Assistant Examiner*—Joseph S Wong
(74) *Attorney, Agent, or Firm*—Morgan, Lewis & Bockius LLP

(57) ABSTRACT

The image forming apparatus is provided with: an image carrier that carries an image; an intermediate transfer belt that is arranged as opposed to the image carrier, and that rotationally moves in a predetermined direction; a primary transfer member that is arranged as opposed to the image carrier through the intermediate transfer belt, and that primarily transfers the image on the image carrier to the intermediate transfer belt; a secondary transfer member that secondarily transfers the image on the intermediate transfer belt to a recording medium; first, second and third hanging members that hang the intermediate transfer belt; and a drive device that transmits drive force to the first and the second hanging members such that drive force by the second hanging member is larger than drive force by the first hanging member.

8 Claims, 10 Drawing Sheets

IMAGE FORMING APPARATUS

CROSS REFERENCE TO RELATED APPLICATIONS

This application is based on and claims priority under 35 USC §119 from Japanese Patent Application No. 2007-165433 filed Jun. 22, 2007.

BACKGROUND

1. Technical Field

The present invention relates to an image forming apparatus that forms an image on a recording medium.

2. Related Art

Conventionally, there is a known image forming apparatus that arranges plural photoconductor drums in line, firstly transfers an image formed on each of the photoconductor drums to an intermediate transfer belt using a primary transfer member, and then secondly transfers the image on the intermediate transfer belt to a recoding medium such as a sheet of paper using a secondary transfer member.

When the recording medium is brought into contact with the intermediate transfer belt, deformation of the intermediate transfer belt due to received impact may occur. Such a phenomenon is more remarkable as, for example, hardness of the recording medium becomes higher. When the intermediate transfer belt is deformed in such a way, moving velocity of the intermediate transfer belt is changed and a positional relationship between the intermediate transfer belt and the primary transfer member is changed. As a result, transfer failure is caused.

An object of the present invention is to suppress the transfer failure that is caused in accordance with the contact of the recording medium with the intermediate transfer belt.

SUMMARY

According to an aspect of the present invention, there is provided an image forming apparatus including: an image carrier that carries an image; an intermediate transfer belt that is arranged as opposed to the image carrier, and that rotationally moves in a predetermined direction; a primary transfer member that is arranged as opposed to the image carrier while the intermediate transfer belt is sandwiched therebetween, and that primarily transfers the image on the image carrier to the intermediate transfer belt; a secondary transfer member that secondarily transfers the image primary-transferred on the intermediate transfer belt to a recording medium; a first hanging member that hangs the intermediate transfer belt on the downstream side of a portion where the image carrier is opposed to the primary transfer member in the moving direction of the intermediate transfer belt; a second hanging member that hangs the intermediate transfer belt on the downstream side of the first hanging member in the moving direct on of the intermediate transfer belt, the second hanging member being arranged as opposed to the secondary transfer member while the intermediate transfer belt is sandwiched therebetween; a third hanging member that hangs the intermediate transfer belt on the downstream side of the second hanging member in the moving direction of the intermediate transfer belt and on the upstream side of the portion where the image carrier is opposed to the primary transfer member in the moving direction of the intermediate transfer belt; and a drive device that transmits drive force to the first hanging member and the second hanging member such that drive force by the second hanging member is larger than drive force by the first hanging member.

BRIEF DESCRIPTION OF THE DRAWINGS

Exemplary embodiment(s) of the present invention will be described in detail based on the following figures, wherein.

DETAILED DESCRIPTION

Hereinafter, exemplary embodiments of the present invention will be described in detail with reference to the attached drawings.

First Exemplary Embodiment

Figure 1:
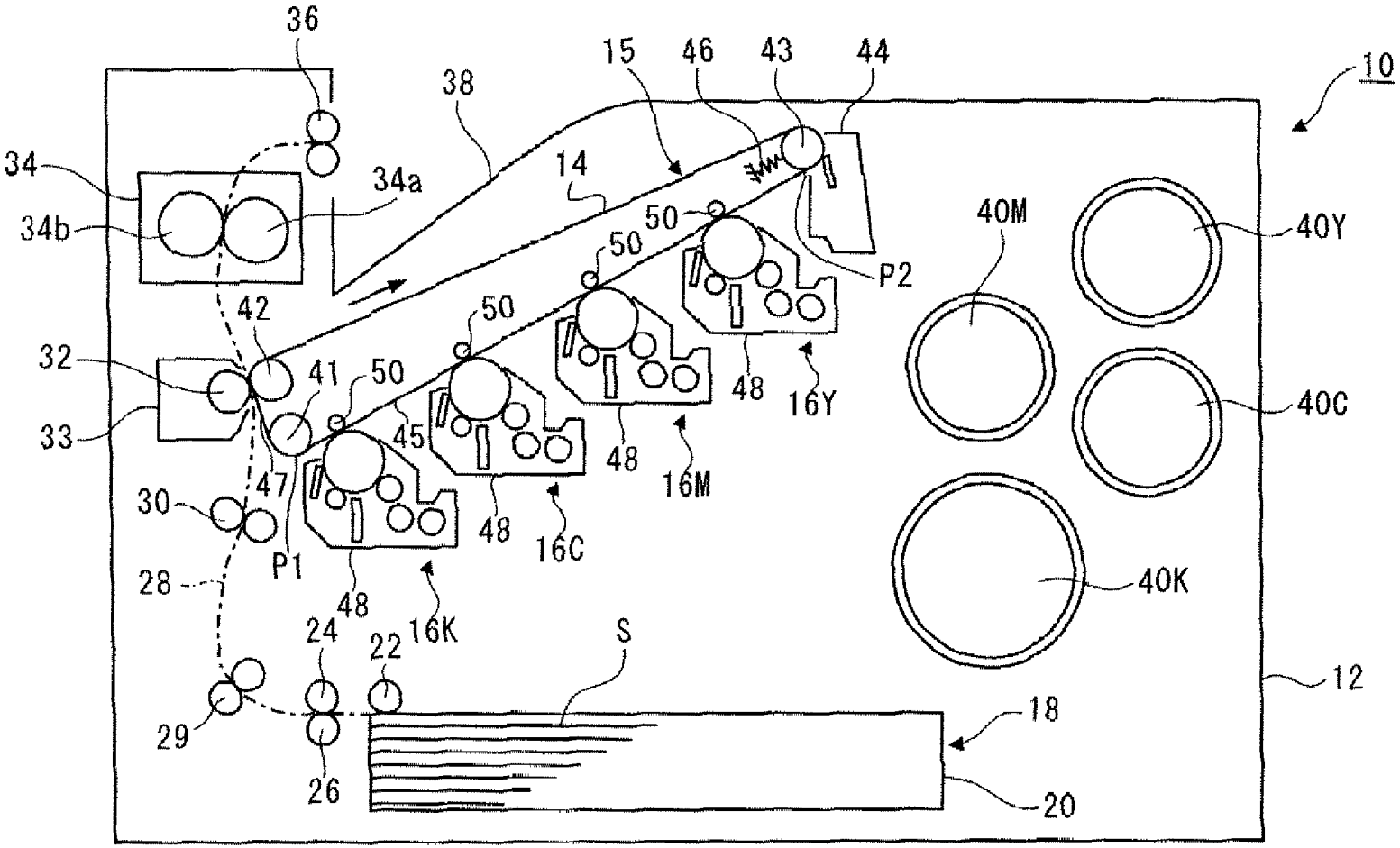
FIG. 1 shows an entire configuration of an image forming apparatus to which the present exemplary embodiment is applied.

FIG. 1 shows an entire configuration of an image forming apparatus 10 to which the present exemplary embodiment is applied. The image forming apparatus 10 has a main body 12 and is provided with a belt unit 15 including an intermediate transfer belt 14, and, for example, four image forming sections 16Y, 16M, 16C and 16K within the main body 12. In the present exemplary embodiment, the plural image forming sections 16Y, 16M, 16C and 16K are arranged diagonally from the top right direction toward the bottom left direction in the figure. The image forming section 16Y forms a toner image of yellow, the image forming section 16M forms a toner image of magenta, the image forming section 16C forms a toner image of cyan, and the image forming section 16K forms a toner image of black. The image forming sections transfer the formed toner image of each color to the intermediate transfer belt 14.

In a lower portion of the main body 12, a sheet feeding device 18 is provided. The sheet feeding device is has a sheet loading unit 20 that is loaded with sheets S serving as the recording medium including a plain paper and an OHP sheet, a takeout roll 22 that takes out the sheets S loaded in the sheet loading unit 20, a feed roll 24 and a retard roll 26 that separate the sheets S one by one and feeds the sheet S. The sheet loading unit 20 is provided detachably from the main body 12 such that the sheet loading unit 20 is taken out to the front side in the figure, for example.

In the vicinity of one end of the main body 12 (in the vicinity of a left end in the figure), a sheet supply route 28 is provided along the substantially vertical direction. In the periphery of the sheet supply route 28, a conveying roll 29, a resist roll 30, a secondary transfer roll 32, a fixing device 34 and a discharge roll 36 are provided along the sheet supply route 28. The resist roll 30 temporarily stops the sheet S that is fed to the sheet supply route 28, and after some time feeds the sheet S toward the secondary transfer roll 32. The fixing device 34 is provided with a heating roll 34*a* and a pressurizing roll 34*b*. By adding heat and pressure to the sheet S that passes through between the heating roll 34*a* and the pressurizing roll 34*b*, a toner image is fixed to the sheet S.

In an upper portion of the main body 12, a discharged paper housing unit 38 is provided. The sheet S with the toner images fixed is discharged to the discharged paper housing unit 38 by the discharge roll 36 mentioned above, and piled up onto the discharged paper housing unit 38. Therefore, the sheet S fed from the sheet loading unit 20 successively passes through a C shaped path and are discharged to the discharged paper housing unit 38.

On the other end side of the main body 12 (on the right side in the figure), four toner bottles 40Y, 40M, 40C and 40K that store developer are provided. Yellow toner is stored in the toner bottle 40Y, magenta toner is stored in the toner bottle 40M, cyan toner is stored in the toner bottle 40C and black toner is stored in the toner bottle 40K. The toner bottles 40Y, 40M, 40C and 40K supply toner of a corresponding colors to the image forming sections 16Y, 16M, 16C and 16K respectively, through supply routes that are formed by pipes and the like respectively (not shown in the figure). The four toner bottles 40Y, 40M, 40C and 40K are provided detachably from the main body 12 such that the toner bottles 40Y, 40M, 40C and 40K are taken out to the front side in the figure, for example.

Each of the image forming sections 16Y, 16M, 16C and 16K has an image forming unit 48 that is arranged as opposing to a surface (an outer peripheral surface) of the intermediate transfer belt 14. Each of the image forming units 48 is detachable from the main body 12, and the image forming unit 48 may be taken out to the front side in the figure after moved to the lower side of the intermediate transfer belt 14 in the figure, for example.

The intermediate transfer belt 14 is hanged by a first roll 41, a second roll 42 and a third roll 43 and supported such that the intermediate transfer belt 14 rotates in the arrow direction in the figure. Here, the third roll 43 gives predetermined tensile force to the intermediate transfer belt 14. In a portion ranging from the third roll 43 to the first roll 41 of the intermediate transfer belt 14, a transfer surface 45 is formed for transferring images (toner images) that are formed by the plural image forming sections 16Y, 16M, 16C and 16K. The transfer surface 45 has a front end portion P2 that is an inlet before the transference and a rear end portion P1 that is an outlet after the transference. The transfer surface 45 from the front end portion P2 to the rear end portion P1 is formed diagonally from the top right to the bottom left in the figure to the horizontal direction. In a portion ranging from the first roll 41 to the second roll 42, a take-in surface 47 where the conveyed sheet S is taken in is formed in the intermediate transfer belt 14. It should be noted that in the present exemplary embodiment, the first roll 41 is used as an example of a first hanging member, the second roll 42 is used as an example of a second hanging member, and the third roll 43 is used as an example of a third hanging member, respectively.

The first roll 41 and the second roll 42 transmit the drive force to the intermediate transfer belt 14 and cause the intermediate transfer belt 14 to rotate in the arrow direction in the figure. It should be noted that in the present exemplary embodiment, the second roll 42 is also used as an example of a backup roll that is arranged as opposing to the secondary transfer roll 32 while the intermediate transfer belt 14 is sandwiched therebetween.

Meanwhile, a spring 46 is connected to the third roll 43 that hangs the intermediate transfer belt 14 with the first roll 41 and the second roll 42. The spring 46 gives force to the third roll 43 in the direction moving away from the first roll 41 and the second roll 42, and gives predetermined tensile force to the intermediate transfer belt 14.

On the inner side of the intermediate transfer belt 14, four primary transfer rolls 50 serving as an example of a primary transfer member are attached so as to be opposed to the image forming units 48 of the image forming sections 16Y, 16M, 16C and 16K respectively. It should be noted that the four primary transfer rolls 50 are rotated in accordance with movement of the intermediate transfer belt 14.

A belt cleaner 44 is arranged on the upper end side of the intermediate transfer belt 14, that is, at a position that is opposed to the third roll 43 while the intermediate transfer belt 14 is sandwiched between the third roll 43 and the belt cleaner 44. Therefore, the third roll 43 is an opposing roll to the belt cleaner 44.

Here, the intermediate transfer belt 14, the first roll 41, the second roll 42, the third roll 43, the four primary transfer rolls 50 and the belt cleaner 44 are integrated as the belt unit 15 mentioned above. The belt unit 15 is detachable from the main body 12 and the belt unit 15 may be taken out to the front side in the figure.

The secondary transfer roll 32 serving as an example of a secondary transfer member is also unitized as a secondary transfer unit 33. The secondary transfer unit 33 is detachable from the main body 12 and the secondary transfer unit 33 may be taken out to the front side in the figure.

Figure 2:
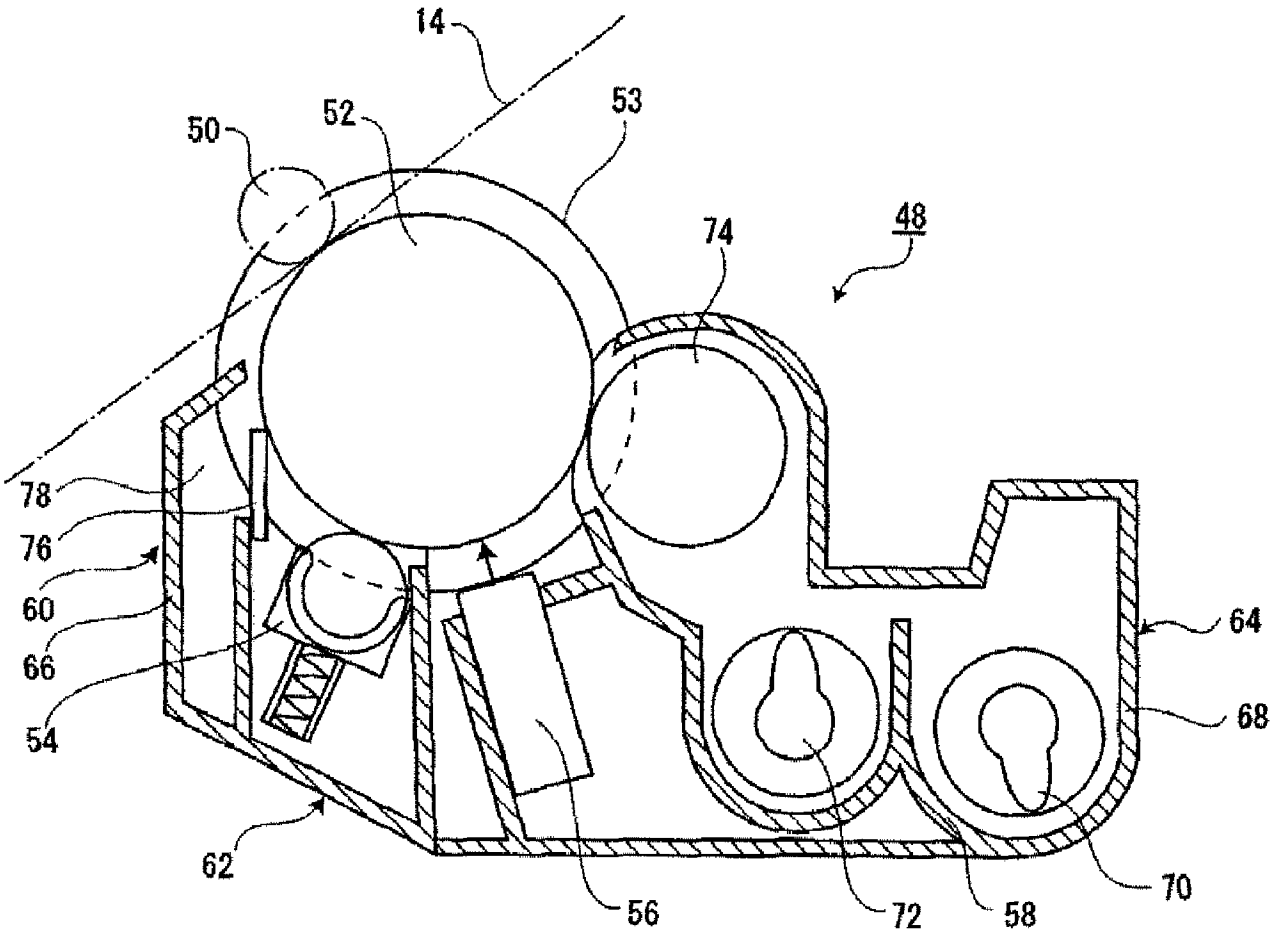
FIG. 2 is a view for explaining the image forming unit configuring each of the image Forming sections.

FIG. 2 is a view for explaining the image forming unit 48 configuring each of the image forming sections 16Y, 16M, 1C and 16K. It should be noted that although color of the developer to be used is different in the image forming sections 16Y, 16M, 16C and 16K, a configuration of the image forming unit 48 is common in the image forming sections 16Y, 16M, 16C and 16K. The image forming unit 48 has a photoconductor drum 52, a charging member 54, an exposure device 56, a developing device 58 and a drum cleaner 60. The photoconductor drum 52 serves as an example of an image carrier that is provided with a photosensitive layer (not shown in the figure). The charging member 54 charges the photoconductor drum 52 and is configured by, for example, a roll and the like. The exposure device 56 forms a latent image on the photoconductor drum 52 and is provided with, for example, a LED (Light Emitting Diode). The developing device 58 develops the latent image on the photoconductor drum 52 that is formed by the exposure device 56 by toner. The drum cleaner 60 cleans up the toner remaining on the photoconductor drum 52 after transfer. It should be noted that, in the present exemplary embodiment, each of the photoconductor drums 52 is used as an example of the image carrier.

The image forming unit 48 is configured by combining a photoconductor unit 62 and a developing unit 64 that are separable each other. In the photoconductor unit 62, the photoconductor drum 52, the charging member 54; the exposure device 56 and the drum cleaner 60 are held in a first housing 66. Meanwhile, in the developing unit 64, the developing device 58 is held in a second housing 68. The first housing 66 and the second housing 68 are separably combined to each other so as to form the image forming unit 48.

In both end portions of the photoconductor drum 52 in the longitudinal direction, a bearing 53 that rotatably supports the photoconductor drum 52 is attached. A part of the bearing 53 is exposed outside of the first housing 66 and the second housing 68 with a part of the photoconductor drum 52.

The developing device 58 adapts a two-component development method of using two-component developer including toner and a carrier as an example of a developer. The developing device 58 has a first auger 70 and a second auger 72that are arranged, for example, in parallel in the horizontal direction, and a developing roll 74 that is arranged in a diagonally upper portion of the second auger 72. The toner and the carrier are agitated and conveyed by the first auger 70 and the second auger 72 and supplied to the developing roll 74. In the developing roll 74, a magnetic brush of the carrier is formed. By the magnetic brush, the toner that is adhered to the carrier is conveyed, and an electrostatic latent image on the photoconductor drum 52 is developed by the toner.

The drum cleaner 60 is provided with a toner scraper portion 76 including, for example, a blade, and a collecting portion 78 that collects the toner scraped by the toner scraper portion 76.

With regard to the image forming apparatus 10 that is configured as mentioned above, in each of the image forming sections 16Y, 16M, 16C and 16K, a surface of the photoconductor drum 52 is uniformly charged by the charging member 54, and the latent image is written on the uniformly charged surface of the photoconductor drum 52 by the exposure device 56. Next, by developing the latent image by the developing device 58, a toner image is formed on the surface of the photoconductor drum 52. The toner image is primarily transferred to the intermediate transfer belt 14 by the primary transfer roll 50. As a result, the toner images formed in the image forming sections 16Y, 16M, 16C and 16K are overlapped with each other on the intermediate transfer belt 14 by primary transfer.

Meanwhile, the sheets S that are loaded on the sheet loading portion 20 are taken cut by the takeout roll 22, and processed into one sheet by the feed roll 24 and the retard roll 26. Then, the sheet S is temporarily stopped by the resist roll 30 and fed into a secondary transfer position by rotation of the resist roll 30 at a predetermined timing.

The toner images that are overlapped with each other on the surface of the intermediate transfer belt 14 are secondarily transferred to the sheet S by the secondary transfer roll 32, and the toner images that are secondarily transferred to the sheet S are fixed by the fixing device 34. The sheet S that finishes the fixing of the toner images is discharged to the discharged paper housing unit 38 through the discharge roll 36.

Figure 3:
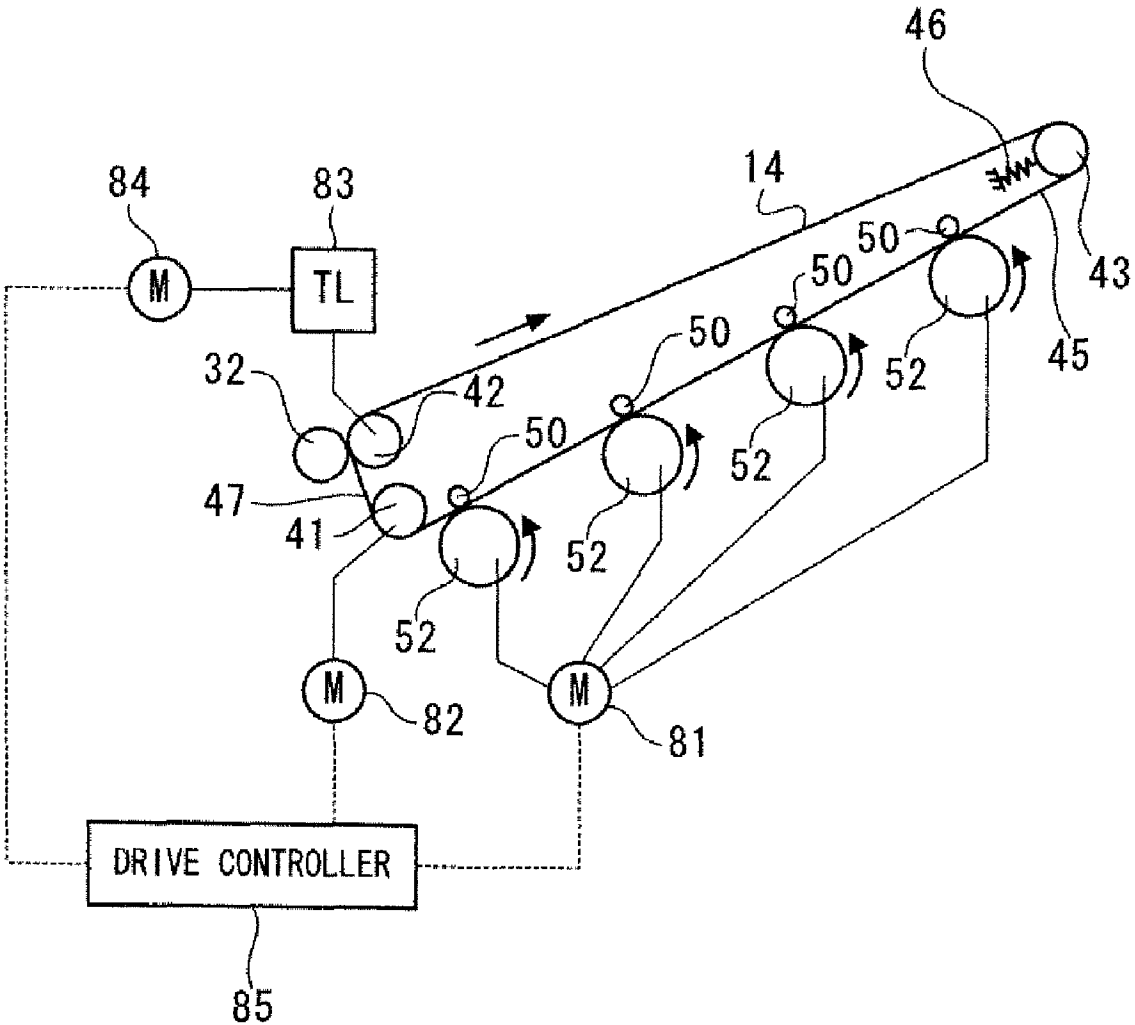
FIG. 3 is a view showing a drive system of the photoconductor drums and the intermediate transfer belt in the image forming apparatus according to the present exemplary embodiment.

FIG. 3 is a view showing a drive system of the photoconductor drums 52 and the intermediate transfer belt 14 in the image forming apparatus 10 according to the present exemplary embodiment.

The intermediate transfer belt 14 is configured by an endless belt that is made of polyimide resin. The first roll 41 and the third roll 43 are configured by metallic rolls such as aluminum and stainless. Meanwhile, the secondary transfer roil 32 and the second roll 42 are configured by metallic shafts with a foamed rubber layer that is formed on an outer circumference thereof. It should be noted that, in the present exemplary embodiment, outer diameters of the first roll 41, the second roll 42 and the third roll 43 are set as all the same.

A drum drive motor 81 is connected to the four photoconductor drums 52. A first drive motor 82 is connected to the first roll 41 and a second drive motor 84 is connected to the second roil 42 through a torque limiter 83 while the first roll 41 and the second roll 42 hang the intermediate transfer belt 14. The intermediate transfer belt 14 is brought into contact with the first roll 41 and the second roll 42 so as to receive the drive force and rotate in the arrow direction in the figure. The drives of the drum drive motor 81, the first drive motor 82 and the second drive motor 84 are controlled by a drive controller 85. It should be noted that, in the present exemplary embodiment, the first drive motor 82, the torque limiter 83 and the second drive motor 84 function as a drive device.

The drive controller 85 controls the drive of the first drive motor 82 and the second drive motor 84 such that second drive force F2 by the second drive motor 84 is larger than first drive force F1 by the first drive motor 82. The second roll 42 rotationally drives the intermediate transfer belt 14 by drive force that is larger than that of the first roll 41. However, the second roll 42 is rotated at the same velocity as the first roll 41 while generating slippage in the torque limiter 83, and causes the intermediate transfer belt 14 to rotate at predetermined belt peripheral velocity.

Meanwhile, the drive controller 85 controls the drum drive motor 81 such that difference is generated between drum circumferential velocity that is circumferential velocity of each of the photoconductor drums 52 and belt peripheral velocity of the intermediate transfer belt 14. It should be noted that, in the present exemplary embodiment, the belt peripheral velocity is slightly slower than the drum circumferential velocity. As mentioned above, by generating a difference of velocity between the drum peripheral velocity and the belt circumferential velocity, friction is caused between each of the photoconductor drums 52 and the intermediate transfer belt 14 in the primary transfer so as to improve transfer efficiency in the primary transfer.

Figure 4:
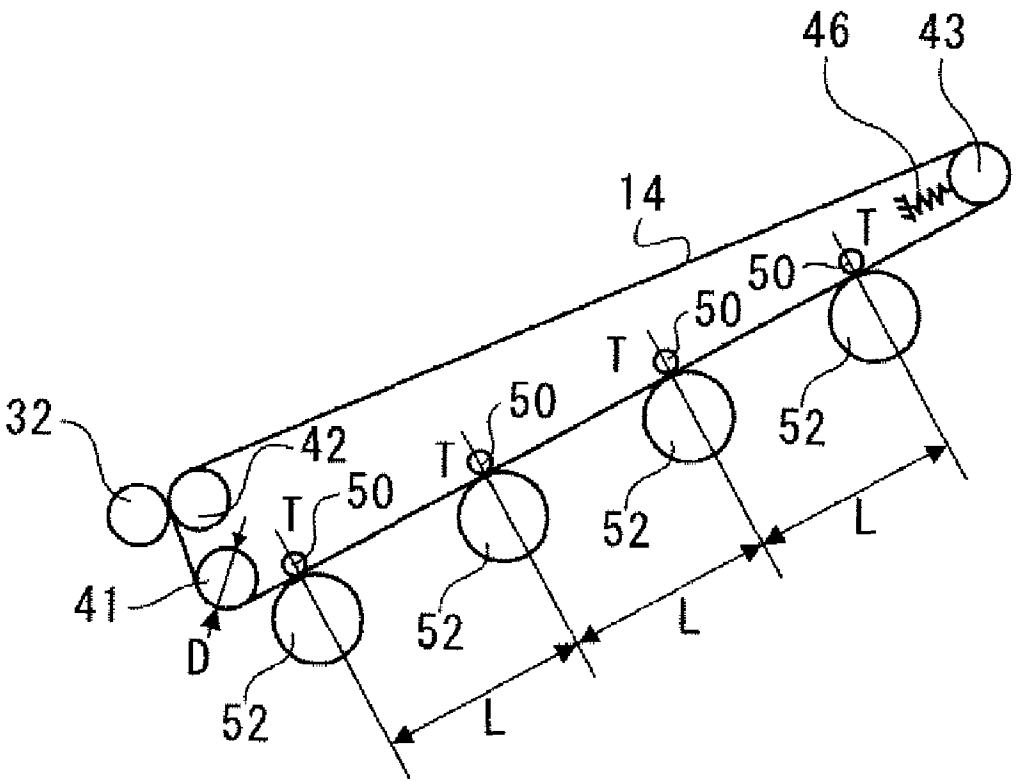
FIG. 4 shows a relationship of a distance between transfer positions where primary transfer rolls arranged adjacent to each other perform the primary transfer and the circumference of the first roll.

FIG. 4 shows a relationship of a distance L between transfer positions T where primary transfer rolls 50 arranged adjacent to each other perform the primary transfer and the circumference of the first roll 41. In the image forming apparatus 10, when a diameter of the first roll 41 is taken as D, setting is made so that the circumference of the first roll 41 $\pi \cdot D$ and the distance L between the transfer positions T becomes equal ($L=\pi \cdot D$). Therefore, for example, even in the case where, due to eccentricity of the first roll 41, unevenness of rotation is caused in the first roll 41 and a periodical change is generated in the belt peripheral velocity of the intermediate transfer belt 14, expansion and contraction of the toner images that are transferred from each of the photoconductor drums 52 to an outer periphery surface of the intermediate transfer belt 14 due to the velocity change correspond to those on the intermediate transfer belt 14. Therefore, image failure such as color drift is not easily generated. As mentioned above, since the diameter of the second roll 42 is the same as the diameter of the first roll 41, a periodical change in the belt peripheral velocity in accordance with eccentricity of the second roll 42 may be properly dealt with for the same reasons. It should be noted that when L is integrally multiplied $\pi \cdot D$ such as $L=2\pi \cdot D$, $3\pi \cdot D$, $4\pi \cdot D$ or the like instead of $L=\pi \cdot D$, the same result may be obtained.

Figure 5:
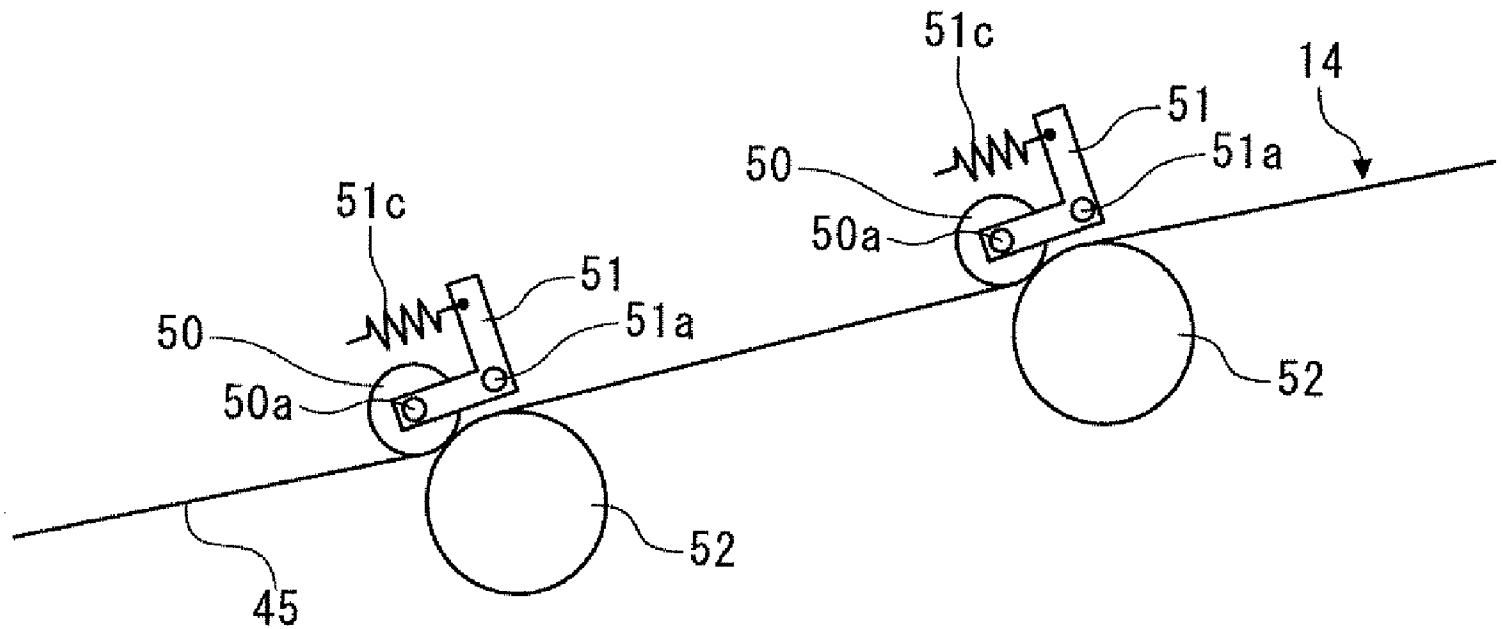
FIG. 5 is a view for explaining a supporting method of the primary transfer rolls.

FIG. 5 is a view for explaining a supporting method of the primary transfer rolls 50.

Each of the primary transfer rolls 50 has a rotation shaft 50*a* serving as an example of a rotation center. Both end portions of the rotation shaft 50*a* in the axial direction are attached to one of protrusion portions of an L shaped arm 51. One end side of a spring 51*c* is attached to the other protrusion portion of the arm 51. A shaft 51*a* is formed in a bent part of the arm 51 and rotatably attached to a frame (not shown in the figure). The other end side of the spring 51*c* is also fixed to the frame (not shown in the figure). Accordingly, since the arm 51 that receives contraction force of the spring 51*c* is rotated taking the shaft 51*a* as a center, the primary transfer rolls 50 are pressed to the intermediate transfer belt 14.

In the above example, to each of the photoconductor drums 52, the corresponding primary transfer roll 50 is disposed so as to be slightly displaced to the downstream side in the moving direction of the intermediate transfer belt 14. Accordingly, the intermediate transfer belt 14 is bent along each of the photoconductor drums 52 so as to extend a primary transfer nip.

Figure 6A:
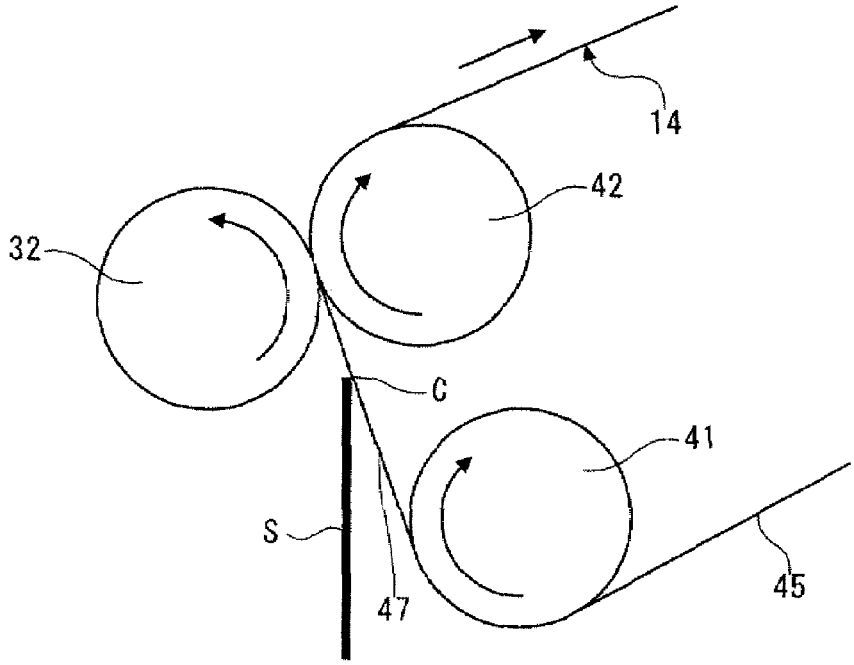
FIGS. 6A and 6B are views showing a state where the sheet runs into a secondary transfer portion that is formed by the secondary transfer roll and the second roll.
Figure 6B:
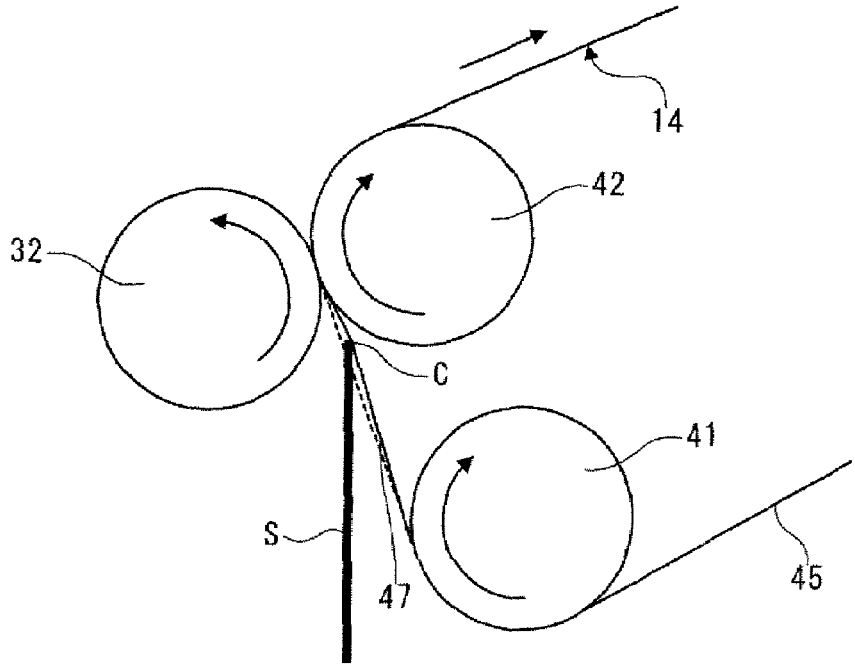
Figure 7:
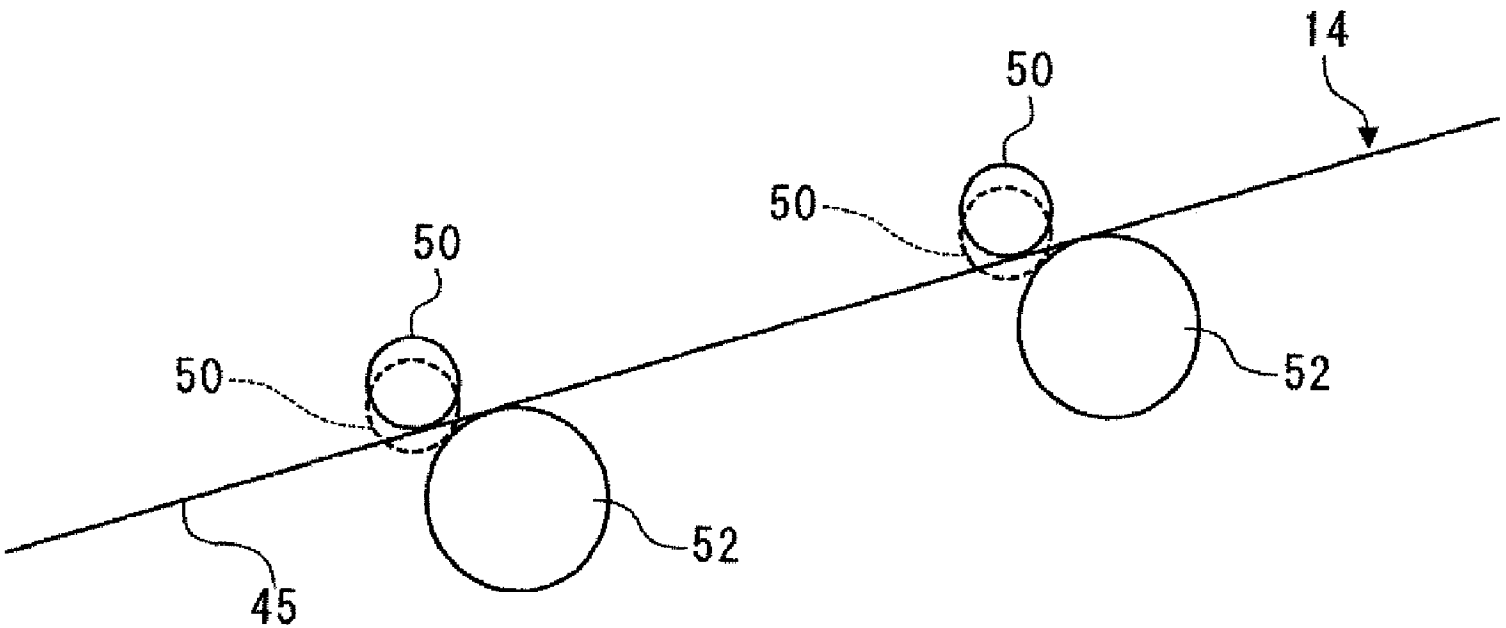
FIG. 7 is a view for explaining relationship between change of tensile force applied to the intermediate transfer belt and change of the transfer nip in the primary transfer roll.

FIGS. 6A and 6B are views showing a state where the sheet S runs into a secondary transfer portion that is formed by the secondary transfer roll 32 and the second roll 42. FIG. 7 is a view for explaining relationship between change of tensile force applied to the intermediate transfer belt 14 and change of the transfer nip in the primary transfer roll 50. In the present exemplary embodiment, as shown in FIG. 6A, the sheet supply route 28 (refer to FIG. 1) is configured such that the sheet S is brought into contact with the intermediate transfer belt 14 at a contact starting position C on the upstream side of the secondary transfer portion of the take-in surface 47 hanged by the first roll 41 and the second roll 42 in the intermediate transfer belt 14, and the sheet S rushes into the secondary transfer portion in a state of being along the intermediate transfer belt 14. This is because in the case where the sheet S is suddenly brought close to the take-in surface 47 of the intermediate transfer belt 14 that retains the toner, spatters are generated by an influence of a charge of the toner on the intermediate transfer belt 14.

However, in the case where the sheet S is heavy paper with hardness, when such the sheet S is brought into contact with the take-in surface 47 of the intermediate transfer belt 14, a dent is generated in the take-in surface 47 due to impact thereof as shown in FIG. 6B. In the case where such a dent is generated in the take-in surface 47, since a perimeter of the intermediate transfer belt 14 is constant, tensile force that is larger than before is applied to the transfer surface 45, for example. Consequently, as shown in FIG. 7, on the transfer surface 45, each of the primary transfer rolls 50 is pressed to the opposite side of each of the photoconductor drums 52 by the intermediate transfer belt 14. As a result, the primary transfer nip between the intermediate transfer belt 14 and the photoconductor drums 52 becomes narrower than the state shown in FIG. 5, and hence primary transfer efficiency in the portion is changed.

Meanwhile, in the present exemplary embodiment, the intermediate transfer belt 14 is driven by the first roll 41 and the second roll 42. Here, the first roll 41 is provided on the upstream side of the contact starting position C in the moving direction of the intermediate transfer belt 14, and the second roll 42 is provided on the downstream side of the contact starting position C in the moving direction of the intermediate transfer belt 14, respectively. The second drive force F2 that drives the second roll 42 is set larger than the first drive force F1 that drives the first roll 41. Therefore, large tensile force in comparison to other surfaces such as the transfer surface 45 is applied to the take-in surface 47 of the intermediate transfer belt 14. Consequently, in the case where heavy paper or the like is used as the sheet S for example, even when front end of the sheet S is brought into contact with the take-in surface 47, the dent, that is, deformation of the take-in surface 47 in accordance with collision with the sheet S is not easily generated. Therefore, the change of the primary transfer nip of the transfer surface 45 is also suppressed. As a result, a decrease in image quality in accordance with the change of the primary transfer efficiency is suppressed.

Second Exemplary Embodiment

Figure 8:
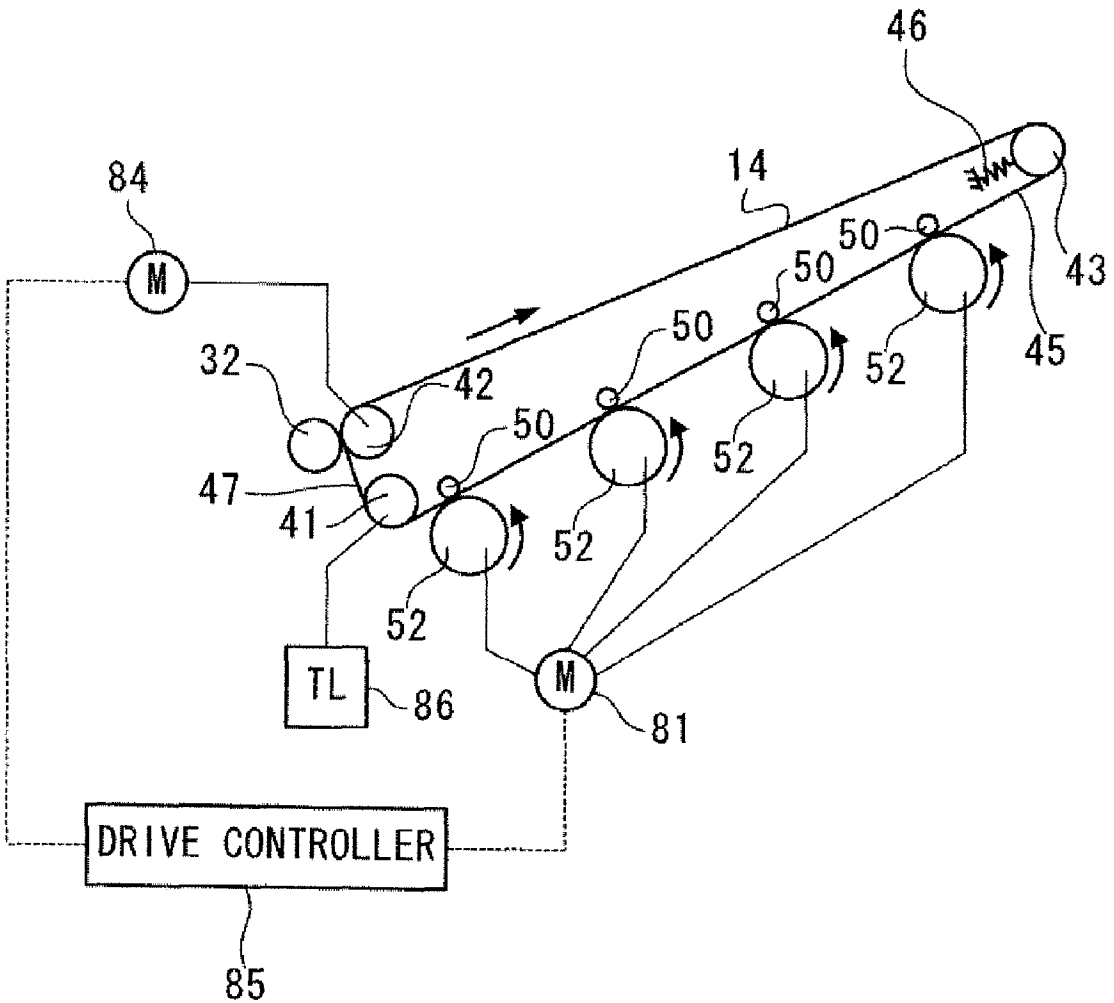
FIG. 8 is a view showing a drive system of each of the photoconductor drums and the intermediate transfer belt in the image forming apparatus according to the present exemplary embodiment.

FIG. 8 is a view showing a drive system of each of the photoconductor drums 52 and the intermediate transfer belt 14 in the image forming apparatus 10 according to the second exemplary embodiment. It should be noted that, in the second exemplary embodiment, the same components as in the first exemplary embodiment are given the same reference numerals and detailed explanation thereof is omitted.

In the second exemplary embodiment, the second drive motor 84 is connected to the second roll 42. A drive source such as a motor is not connected to the first roll 41, but one side of the torque limiter 86 is connected to the first roll 41. The other side of the torque limiter 86 is fixed to the frame (not shown in the figure) or the like so as not to rotate.

In the second exemplary embodiment, the intermediate transfer belt 14 is rotated by the drive force of the second roll 42. At that timer the first roll 41 that is provided on the upstream side of the second roll 42 in the moving direction of the intermediate transfer belt 14 is rotated while receiving rotational resistance, that is, braking by the torque limiter 86. Therefore, large tensile force in comparison to other surfaces such as the transfer surface 45 is applied to the take-in surface 47 of the intermediate transfer belt 14 similar to the first exemplary embodiment. Consequently, for the same reasons as the first exemplary embodiment, the deformation of the intermediate transfer belt 14 in accordance with the rush of the sheet S and the change of the primary transfer nip in accordance with the deformation of the intermediate transfer belt 14, and furthermore the change of the primary transfer efficiency are suppressed. In the second exemplary embodiment, the number of motor that rotationally drives the intermediate transfer belt 14 may be lower than the first exemplary embodiment.

It should be noted that, in the second exemplary embodiment, the braking is performed by attaching the torque limiter 86 to the first roll 41. However, for example, the first roll 41 may be attached in a state where the first roil 41 is not rotated so that the braking is performed on the intermediate transfer belt 14 by frictional force. Further, it should be noted that, in the second exemplary embodiment, the second drive motor 84 and the torque limiter 86 function as an example of a drive device.

Third Exemplary Embodiment

Figure 9:
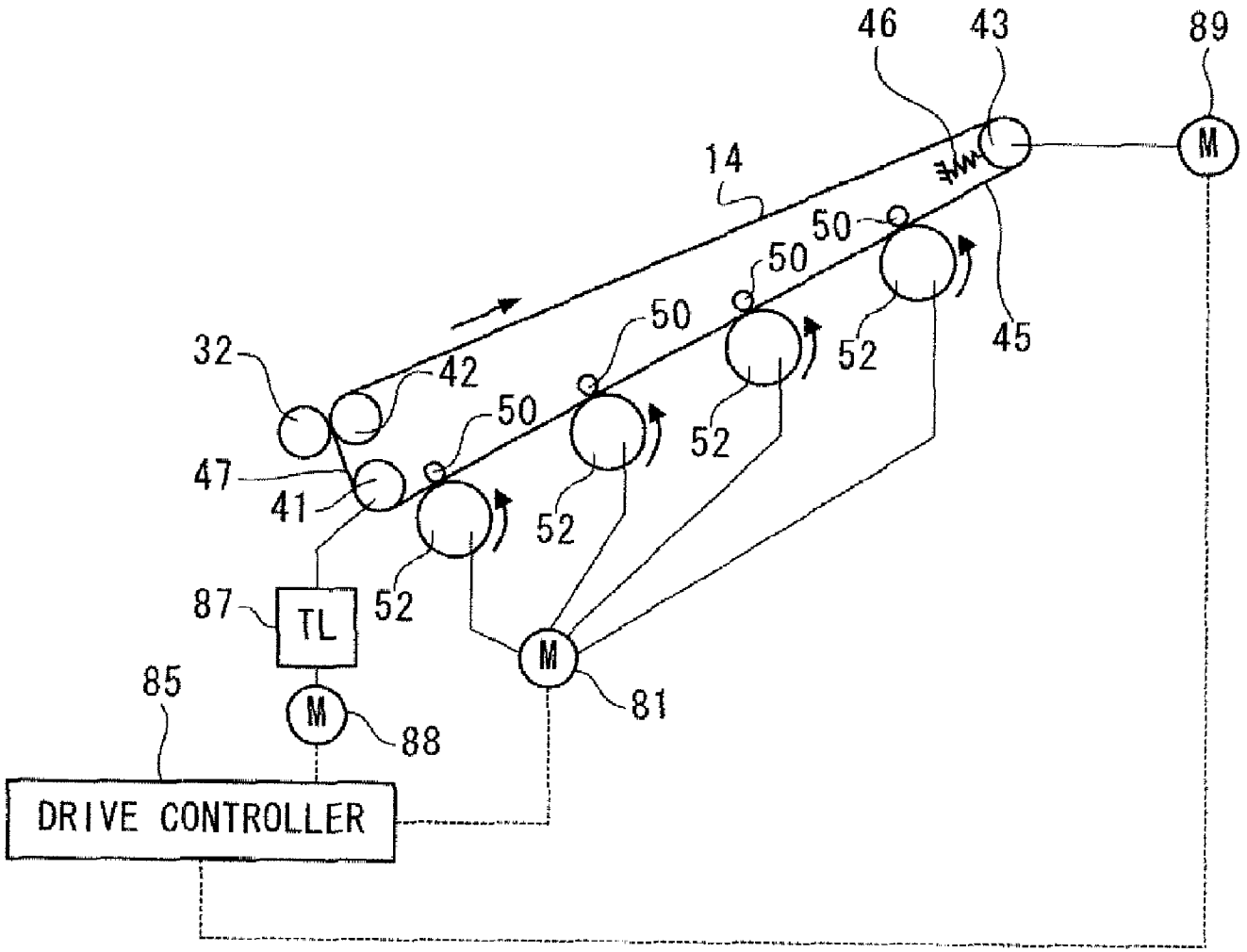
FIG. 9 is a view showing a drive system of each of the photoconductor drums and the intermediate transfer belt in the image forming apparatus according to the present exemplary embodiment.

FIG. 9 is a view showing a drive system of each of the photoconductor drums 52 and the intermediate transfer belt 14 in the image forming apparatus 10 according to the third exemplary embodiment. It should be noted that, in the third exemplary embodiment, the same components as in the second exemplary embodiment are given the same reference numerals and detailed explanation thereof is omitted.

In the third exemplary embodiment, the first roll 41 that is provided on the downstream side of the transfer surface 45 and the third roll 43 that is provided on the upstream side of the transfer surface 45 are driven, while the second roll 42 is freely rotated.

A drum drive motor 81 is connected to the four photoconductor drums 52. A main drive motor 88 is connected to the first roll 41 that hangs the intermediate transfer belt 14 through a torque limiter 87, and a supplementary drive motor 89 is connected to the third roll 43. The intermediate transfer belt 14 is brought into contact with the first roll 41 and the third roll 43 so as to receive the drive force and rotate in the arrow direction in the figure. The drives of the drum drive motor 81, the main drive motor 88 and the supplementary drive motor 89 are controlled by a drive controller 85. It should be noted that, in the third exemplary embodiment, the torque limiter 87, the main drive motor 88 and the supplementary drive motor 89 function as an example of a drive device.

The drive controller 85 controls the drive of the main drive motor 88 and the supplementary drive motor 89 such that main drive force FM by the main drive motor 88 is larger than supplementary drive force FS by the supplementary drive motor 89. The first roll 41 rotationally drives the intermediate transfer belt 14 by drive force that is larger than that of the third roll 43. However, the first roll 41 is rotated at the same velocity as the third roll 43 while generating slippage in the torque limiter 87, and causes the intermediate transfer belt 14 to rotate at the predetermined belt peripheral velocity. In addition, the drive controller 85 controls the drum drive motor 81 such that difference is generated between drum circumferential velocity that is circumferential velocity of each of the photoconductor drums 52 and belt peripheral velocity of the intermediate transfer belt 14.

In the third exemplary embodiment, when the sheet S is brought into contact with the take-in surface 47, the take-In surface 47 may be deformed due to the impact of the collision.

Meanwhile, in the third exemplary embodiment, the intermediate transfer belt 14 is driven by the first roll 41 and the third roll 43. Here, the first roll 41 is provided on the downstream side of the transfer surface 45, and the third roll 43 is provided on the upstream side of the transfer surface 45, respectively. Main drive force FM that drives the first roll 41 is set larger than supplementary drive force FS that drives the third roll 43. Therefore, large tensile force in comparison to other surfaces such as the take-in surface 47 is applied to the transfer surface 45 of the intermediate transfer belt 14. Consequently, in the case where the heavy paper is used as the sheet S for example, even when the take-in surface 47 is deformed by the contact of the front end of the sheet S with the take-in surface 47, the deformation is not easily generated in the transfer surface 45. Therefore, the change of the primary transfer nip of the transfer surface 45 is also suppressed. As a result, the decrease in image quality in accordance with the change of the primary transfer efficiency is suppressed.

Fourth Exemplary Embodiment

Figure 10:
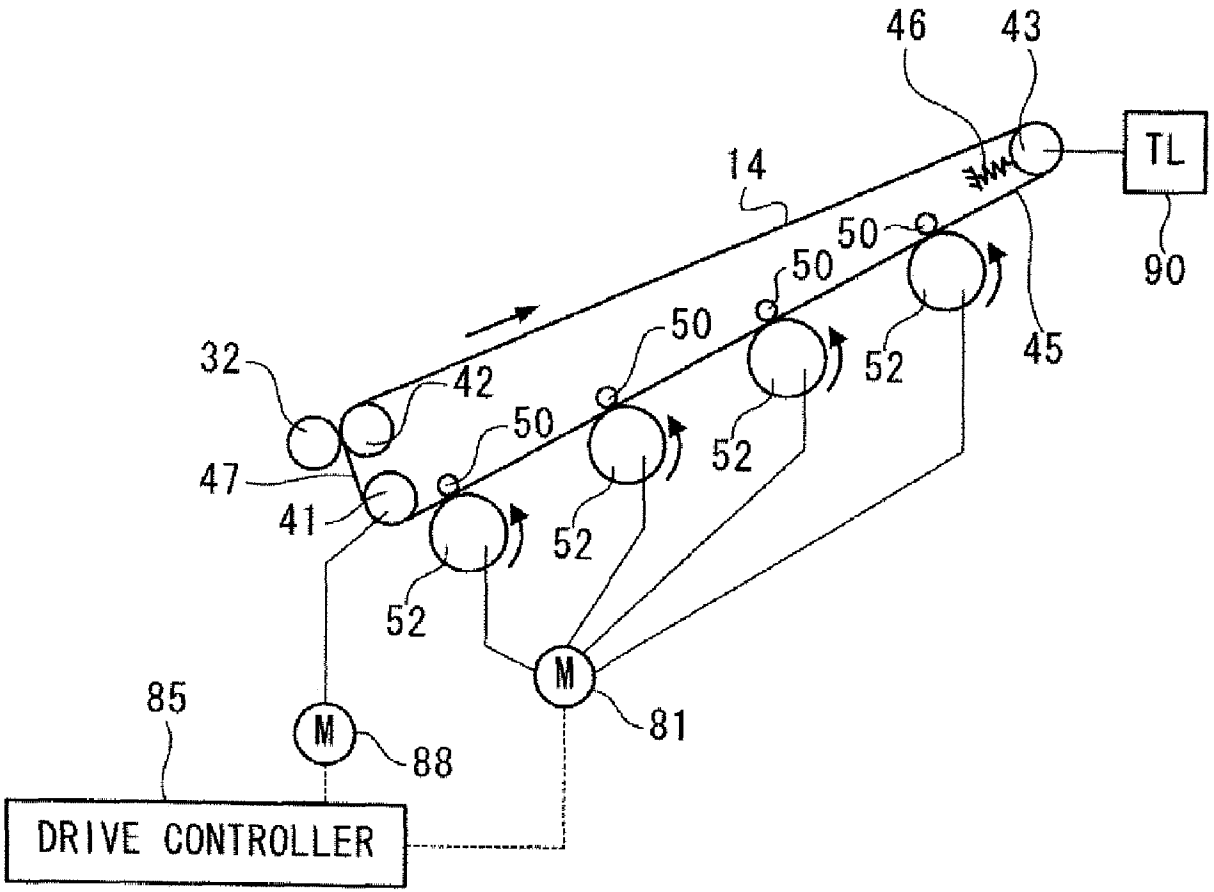
FIG. 10 is a view showing a drive system of each of the photoconductor drums and the intermediate transfer belt in the image forming apparatus according to the present exemplary embodiment.

FIG. 10 is a view showing a drive system of each of the photoconductor drums 52 and the intermediate transfer belt 14 in the image forming apparatus 10 according to the fourth exemplary embodiment. It should be noted that, in the fourth exemplary embodiment, the same components as in the third exemplary embodiment are given the same reference numerals and detailed explanation thereof is omitted.

In the fourth exemplary embodiment, the main drive motor 88 is connected to the first roll 41. A drive source such as a motor is not connected to the third roll 43, but one side of the torque limiter 90 is connected to the third roll 43. The other side of the torque limiter 90 is fixed to the frame (not shown in the figure) or the like so as not to rotate. In the fourth exemplary embodiment, the main drive motor 88 and the torque limiter 90 function as an example of a drive device.

In the fourth exemplary embodiment, the intermediate transfer belt 14 is rotated by the drive force of the first roll 41. At that time, the third roll 43 that is provided on the upstream side of the first roll 41 in the moving direction of the intermediate transfer belt 14 is rotated while receiving rotational resistance, that is, braking by the torque limiter 90. Therefore, large tensile force in comparison to other surfaces such as the take-in surface 47 is applied to the transfer surface 45 of the intermediate transfer belt 14 similar to the third exemplary embodiment. Consequently, for the same reasons as the third exemplary embodiment, even when the deformation of the take-in surface 47 in accordance with the rush of the sheet S is generated, the change of the primary transfer nip in accordance with the deformation of the transfer surface 45, and furthermore the change of the primary transfer efficiency are suppressed. In the fourth exemplary embodiment, the number of motor that drives the intermediate transfer belt 14 may be lower than the third exemplary embodiment.

It should be noted that, in the fourth exemplary embodiment, the braking is performed by attaching the torque limiter 90 to the third roll 43. However, for example, the third roll 43 may be attached so as not to be rotated so that the braking is performed on the intermediate transfer belt 14 by frictional force.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier that carries an image;

an intermediate transfer belt that is arranged as opposed to the image carrier, and that rotationally moves in a predetermined direction;

a primary transfer member that is arranged as opposed to the image carrier while the intermediate transfer belt is sandwiched therebetween, and that primarily transfers the image on the image carrier to the intermediate transfer belt;

a secondary transfer member that secondarily transfers the image primary-transferred on the intermediate transfer belt to a recording medium;

a first hanging member that hangs the intermediate transfer belt on the downstream side of a portion where the image carrier is opposed to the primary transfer member in the moving direction of the intermediate transfer belt;

a second hanging member that hangs the intermediate transfer belt on the downstream side of the first hanging member in the moving direction of the intermediate transfer belt, the second hanging member being arranged as opposed to the secondary transfer member while the intermediate transfer belt is sandwiched therebetween;

a third hanging member that hangs the intermediate transfer belt on the downstream side of the second hanging member in the moving direction of the intermediate transfer belt and on the upstream side of the portion where the image carrier is opposed to the primary transfer member in the moving direction of the intermediate transfer belt; and a drive device that transmits drive force to the first hanging member and the second hanging member such that drive force by the second hanging member is larger than drive force by the first hanging member.

2. The image forming apparatus according to claim 1, wherein the drive device transmits first drive force to the first hanging member, and transmits second drive force that is larger than first drive force to the second hanging member through a torque limiter.

3. The image forming apparatus according to claim 1, wherein the drive device brakes the first hanging member, and transmits drive force to the second hanging member.

4. The image forming apparatus according to claim 1, wherein the recording medium is taken in into a portion hanged between the first hanging member and the second hanging member in the intermediate transfer belt while being in contact with the portion.

5. An image forming apparatus comprising:

an image carrier that carries an image;

an intermediate transfer belt that is arranged as opposed to the image carrier, and that rotationally moves in a predetermined direction;

a primary transfer member that is arranged as opposed to the image carrier while the intermediate transfer belt is sandwiched therebetween, and that primarily transfers the image on the image carrier to the intermediate transfer belt;

a secondary transfer member that secondarily transfers the image primary-transferred on the intermediate transfer belt to a recording medium;

a first hanging member that hangs the intermediate transfer belt on the downstream side of a portion where the image carrier is opposed to the primary transfer member in the moving direction of the intermediate transfer belt;

a second hanging member that hangs the intermediate transfer belt on the downstream side of the first hanging member in the moving direction of the intermediate transfer belt, the second hanging member being arranged as opposed to the secondary transfer member while the intermediate transfer belt is sandwiched therebetween;

a third hanging member that hangs the intermediate transfer belt on the downstream side of the second hanging member in the moving direction of the intermediate transfer belt and on the upstream side of the portion where the image carrier is opposed to the primary transfer member in the moving direction of the intermediate transfer belt; and a drive device that transmits drive force to the first hanging member and the third hanging member such that drive force by the first hanging member is larger than drive force by the third hanging member.

6. The image forming apparatus according to claim 5, wherein the drive device transmits supplementary drive force to the third hanging member, and transmits main drive force that is larger than the supplementary drive force to the first hanging member through a torque limiter.

7. The image forming apparatus according to claim 5, wherein the drive device brakes the third hanging member, and transmits drive force to the first hanging member.

8. The image forming apparatus according to claim 5, wherein the recording medium is taken in into a portion hanged between the first hanging member and the second hanging member in the intermediate transfer belt while being in contact with the portion.

* * * * *